US010058737B2

(12) United States Patent
Piumatti

(10) Patent No.: US 10,058,737 B2
(45) Date of Patent: Aug. 28, 2018

(54) APPARATUS FOR WEARING FINS

(71) Applicant: Paolo Piumatti, Ustica (IT)

(72) Inventor: Paolo Piumatti, Ustica (IT)

( * ) Notice: Subject to any disclaimer, the term of this patent is extended or adjusted under 35 U.S.C. 154(b) by 74 days.

(21) Appl. No.: 15/311,204

(22) PCT Filed: May 15, 2015

(86) PCT No.: PCT/IB2015/053588
§ 371 (c)(1),
(2) Date: Nov. 15, 2016

(87) PCT Pub. No.: WO2015/177695
PCT Pub. Date: Nov. 26, 2015

(65) Prior Publication Data

US 2017/0095698 A1 Apr. 6, 2017

(30) Foreign Application Priority Data

May 19, 2014 (IT) ..... BO2014A0293

(51) Int. Cl.

| | |
|---|---|
| ***A63B 31/11*** | (2006.01) |
| ***A47G 25/80*** | (2006.01) |
| ***A47G 25/82*** | (2006.01) |
| ***A47G 25/90*** | (2006.01) |

(52) U.S. Cl.
CPC ..... *A63B 31/11* (2013.01); *A47G 25/80* (2013.01); *A47G 25/82* (2013.01); *A47G 25/90* (2013.01)

(58) Field of Classification Search
CPC ..... A63B 31/08; A63B 31/10; A63B 31/11; A47G 25/80; A47G 25/82; A47G 25/84; A47G 25/90–25/907
See application file for complete search history.

(56) References Cited

U.S. PATENT DOCUMENTS

| | | | | |
|---|---|---|---|---|
| 2,446,777 | A * | 8/1948 | Menenko | A43B 11/02 36/1 |
| 2,828,057 | A * | 3/1958 | Maclauchlan | A47G 25/905 223/111 |
| 3,012,702 | A * | 12/1961 | Van Der Vliet | A47G 25/82 223/113 |
| 3,178,738 | A | 4/1965 | La Trell | |
| 4,795,384 | A | 1/1989 | Hattori | |

(Continued)

FOREIGN PATENT DOCUMENTS

| | | |
|---|---|---|
| CN | 101559277 | 5/2013 |
| EP | 0687484 | 8/1998 |

(Continued)

OTHER PUBLICATIONS

International Search Report dated Sep. 14, 2015 from counterpart PCT/IB2015/053588.

*Primary Examiner* — Ismael Izaguirre
(74) *Attorney, Agent, or Firm* — Shuttleworth & Ingersoll, PLC; Timothy J. Klima

(57) ABSTRACT

An apparatus for putting on flippers retaining means of a user's foot inside a shoe of a flipper, and in which apparatus the retaining means are mechanically connected and pivoted to removable mounting means of the shoe of the flipper, the removable mounting means being removably associable to a portion of the base of the shoe.

13 Claims, 6 Drawing Sheets

(56) References Cited

U.S. PATENT DOCUMENTS

| | | | | | |
|---|---|---|---|---|---|
| 5,083,954 | A * | 1/1992 | Jacobs | A63B 31/11 | 441/64 |
| 5,282,327 | A * | 2/1994 | Ogle | A43B 11/00 | 36/105 |
| 5,806,729 | A * | 9/1998 | Ramon | A47G 25/80 | 223/113 |
| 7,140,937 | B2 * | 11/2006 | Cadorette | A43B 5/08 | 441/64 |
| 9,332,869 | B1 * | 5/2016 | Beaudette | A47G 25/80 | |
| 2017/0095698 | A1 * | 4/2017 | Piumatti | A63B 31/11 | |

FOREIGN PATENT DOCUMENTS

| | | |
|---|---|---|
| FR | 2744639 | 8/1997 |
| WO | WO9912612 | 3/1999 |

* cited by examiner

APPARATUS FOR WEARING FINS

This application is the National Phase of International Application PCT/IB2015/053588 filed May 15, 2015 which designated the U.S.

This application claims priority to Italian Patent Application No. BO2014A000293filed May 19, 2014, which application is incorporated by reference herein.

TECHNICAL FIELD

The invention relates to an apparatus for putting on flippers.

In particular the term flippers relates to all footwear which can be used for various sporting activities, such as underwater diving, swimming and so on.

A possible application of the invention relates to flippers, to which reference will be made by way of example below.

BACKGROUND ART

Flippers for swimming are generally provided with a large propulsion portion due to the presence of a flexible blade (flipper). Swimming flippers have, in addition to the flexible blade, a seating in the form of a shoe integral with the blade itself and enabling insertion of the foot of person wearing the flipper, for example the swimmer or underwater swimmer. The shoe in particular comprises a rear part which does not contain the foot, therefore open at the heel, for introducing the foot in the housing thereof.

Normally, for retaining the foot in the opening, this type of flipper has a strap or elastic belt hooked laterally of the flipper shoe.

In order to fit the flippers and fasten them to the underwater swimmer's foot, using elastic straps or other known fastening means, the underwater swimmer has to count on the assistance of another person or has to crouch with movements that are laborious and involve bending. These movements are conditioned, for most users, by their own weight and the weight of the equipment being carried, as the user has to stand on a single leg for the time needed to put on each flipper, and this generates significant difficulty.

This difficulty brings with it a high risk of falling and therefore of accidents, in particular when done not in conditions of leisure on a beach, but on rocks potentially wetted by the waves or on a slippery surface, for example due to the presence of seaweed, limpets and barnacles and so on. It is still more difficult to don the flippers on an unstable navigation means, such as, for example, a dinghy or a small or medium-size boat when rocking on a slightly rough or choppy sea and when there is a supporting surface that is slippery.

There is therefore a need to make flippers with special connections for the straps so that they are easily adjustable, as described in patents U.S. Pat. No. 4,795,384 and EP0687484. These systems are integrated with the flippers and, though more comfortable compared with conventional systems, they do not obviate demanding movements and hence the user having to bend, made necessary so as to reach the foot with the hands.

A further prior art disclosure is described in patent application WO9912612. It describes a flipper in which the normal strap is substituted with an apparatus having two static positions.

The first static position is lowered and leaves the opening of the shoe of the flipper free, keeping a strap of the connection between the shoe and the apparatus tautened, and the second static position is raised for keeping the foot inside the shoe.

The first stable position is realised by placing the fulcrum of rotation of the apparatus in a defined position of the shoe where the strap applies neither force nor momentum at any time about the anchoring pin, the lever arm being reduced substantially to zero, and therefore even if the strap is kept in tension, the apparatus remains in equilibrium in the first position.

A drawback of a solution of this type is that during use in underwater diving or swimming, the apparatus might pass from the second retaining position of the foot to the first position in an undesired and uncontrolled way, causing the loss of the entire flipper, as the strap is not always tensioned towards the second position. In particular, as the apparatus loosens, the momentum reduces progressively up to zero, reaching zero when it is in the first position. A further disadvantage is that the apparatus might pass beyond the pin anchoring element and therefore become positioned beneath the flipper in a position opposite the first position, making correct repositioning thereof extremely difficult, which could occur only with the person making very problematic bending movements, with the risks as set out above.

A further example of prior art is described in French patent application FR2744639. This patent describes a flipper which has a shoe, joined to the flipper, and a separate heel. The heel has a tongue, projecting forwards, which engages in an opening beneath the flipper. The position of the heel is adjustable as a function of the length of the user's foot. The tongue has a slot which has saw-tooth elements along an edge thereof. An opening clip, with a hook on a free end thereof, engages with the teeth to keep the tongue in position. The tongue is released by pressing on a pin which protrudes from the opening.

A disadvantage of this technique is that it is necessary for the user to act with the hands, in precarious equilibrium, for inserting the tongue in the clip, and this action has features of great uncertainty, difficulty and high instability, being extremely risky for the reasons set out in the foregoing.

A disadvantage shared by the entire prior art described above is that the flippers must be made with the provided devices and therefore these apparatuses are not applicable to traditional flippers already present on the market, or already in the possession of underwater swimmers.

AIM OF THE INVENTION

An aim of the invention is to obviate the drawbacks of the prior art described above.

A further aim of the invention is to provide an apparatus for fastening the foot of a person into an item of footwear, such as a swimming flipper.

A further aim is to provide an apparatus for fastening the foot of a person in an item of footwear which can be easily fixed without the use of the person's hands and be easily released with minimum force, all done in conditions of maximum safety.

A further aim of the invention is to provide an apparatus which can be used in flippers of the conventional type without the need for structural modifications to the shoe of the flipper or to a part thereof.

The technical purpose indicated and the aims specified are substantially achieved by an electrical machine according to claim 1.

BRIEF DESCRIPTION OF THE DRAWINGS

Further characteristics and advantages of this invention are more apparent in the detailed description below, with reference to a preferred, non-limiting embodiment of a machine as illustrated in the accompanying drawings, in which.

DETAILED DESCRIPTION OF PREFERRED EMBODIMENTS OF THE INVENTION

Figure 1:
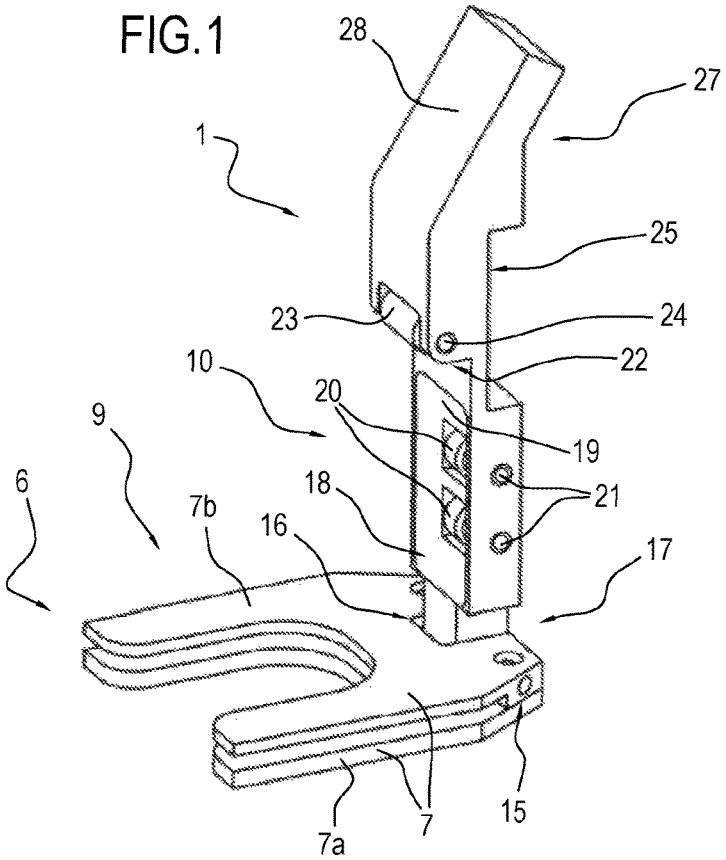
FIG. 1 illustrates an apparatus according to the invention in a schematic perspective view, partial and with some parts removed for greater clarity.

With reference to the accompanying figures, reference numeral 1 denotes a machine for putting on flippers 2, such as, for example, flippers for underwater swimmers, defined in their entirety as users, to which explicit reference will be made without losing in terms of general applicability.

In the described embodiment reference the term "flippers" will be used to refer to all footwear which can be used for various sporting activities such as underwater immersion, swimming and so on.

In particular the flipper 2 to which reference is made herein comprises a part for inserting the underwater swimmer's foot which will be referred-to as a shoe 3, and a part that comprises a blade 4 which is constituted for generating a large portion of propulsion. The blade 4 has a flexible laminar shape, constituting the flipper proper, and is illustrated only partially in figures from 3 to 5 being interrupted by a saw-toothed line.

Further, the shoe 3 of the flipper 2 is without a rear containing part, that is to say, a rear part open at the position of the user's heel, so as to enable introduction of the foot in a housing 5, constituting the seating for the foot.

Figure 2:
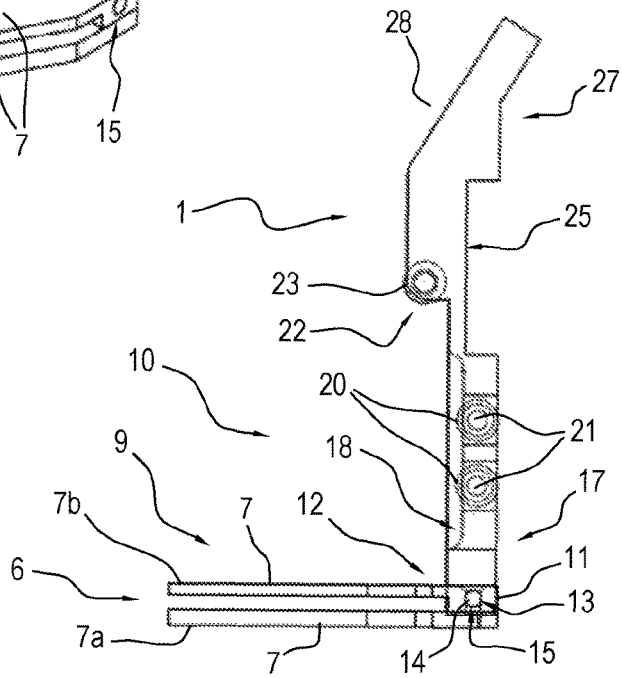
FIG. 2 is the apparatus for putting on flippers according to the invention in a partial schematic side view and with some parts removed for greater clarity.

With reference to FIGS. 1 and 2, the apparatus 1 comprises retaining means 10 of the foot of the underwater swimmer in the correct position inside the housing 5 of the flipper 2 itself and comprises removable attaching means 9 to the flipper 2. The retaining means 10 and the attaching means 9 are mechanically connected to one another.

The attaching means 9 to the flipper 2 comprise a pair of jaws 6, which in a preferred embodiment are each made with a substantially U-shaped plate 7.

The two plates 7 are facing each other and spaced by an amount such as to enable insertion of a base or sole 8 of the shoe 3 of the flipper 2. The distance between the two plates 7 is therefore approximately the thickness of the material which forms the sole 8.

The attaching means 9 are therefore removably associable way to a portion of the base 8 of the shoe 3.

In this way, in use, the sole 8 of the shoe 3 is interposed between a lower plate 7*a* , positioned below the sole 8 of the flipper 2, and an upper plate 7*b*, positioned above the sole 8 and partly inside the housing 5 (see FIG. 5).

The upper plate 7*b* is preferably made of an elastic material. This means that, following a slight deformation thereof, the sole 8 can be gripped by the jaws 6 so as to be retained, in such a way as to enable connection of the apparatus 1 to the flipper 2 during use thereof.

The distance between the two plates 7 is defined by the thickness of a raised part 11 present in the upper plate 7*b* at an end 12 thereof, which, in use, is positioned externally of the shoe 3 and is positioned at the base of above-mentioned U-shape. This thickness of the raised part 11 can depend on the thickness of the sole 8. The elasticity of the material of the plate 7*b* can however be sufficient to cover different thickness measurements, so as to guarantee a broad versatility of the apparatus, irrespective of the flipper 2 to which it is applied.

As shown in FIG. 2, inside the raised part 11 there is a through-hole 13 having an axis parallel to the lie plane defined by the plates 7. A spindle 14 is present internally of the hole. The spindle 14 in the hole 13 constitutes a hinge 15 in which the retaining means 10 are pivoted. The retaining means 10 and the attaching means 9 are mechanically reciprocally pivoted.

The retaining means 10 are partly located in the seat of a recess 16 made in the plates 7 and have a passage which is able to partly house the spindle 14, which passes through a through-hole. The spindle 14 can be rigidly connected to the plates 7 and the retaining means 10 can be free to rotate about the spindle 14. Vice versa the spindle 14 can be rigidly connected to the retaining means 10 and the plates 7 free to rotate about it.

The retaining means 10 of the heel of the foot comprise a structure which has various characteristics. In particular, the retaining means 10 comprise a first end 17 that engages in the recess 16. An opposing zone 18 to the heel is present in proximity of the first end 17, which opposing zone 18 in turn comprises a slot 19 fashioned in the solid body of the heel and having an anatomical shape with respect to the heel. This slot 19 constitutes a supporting seat of the heel when the apparatus is in use.

Two rollers 20 are located on the bottom of the slot 19, which rollers 20 are mounted rotatably about two spindles 21 blocked in the structural part of the retaining means 10. The rollers 20 may be in a greater number than two but they might also be only one in number, without thereby limiting the realising of further preferred embodiments of the invention which are not illustrated.

Beyond the slot 19, on the side opposite to the first end 17, a step 22 is present which constitutes a stop and abutment element for the heel, in such a way that accidental exit the foot is not possible, when, in use, the foot is fitted inside the shoe 3.

At least a roller 23 is mounted in proximity of the step 22, which roller 23 is mounted in a similar way to the rollers 20 by means of a spindle 24.

In the preferred embodiment, illustrated in FIG. 1, the roller 23 has a portion of the cylindrical surface thereof exiting from the step 22.

Thus the rollers 20 also have a surface part of the cylindrical surface exiting from the slot 19.

The presence thereof constitutes a facilitation for the sliding of the foot during insertion in the shoe 3, in particular when the foot of the underwater swimmer is covered by a suitable footwear for the immersions, for example a boot.

Figure 3:
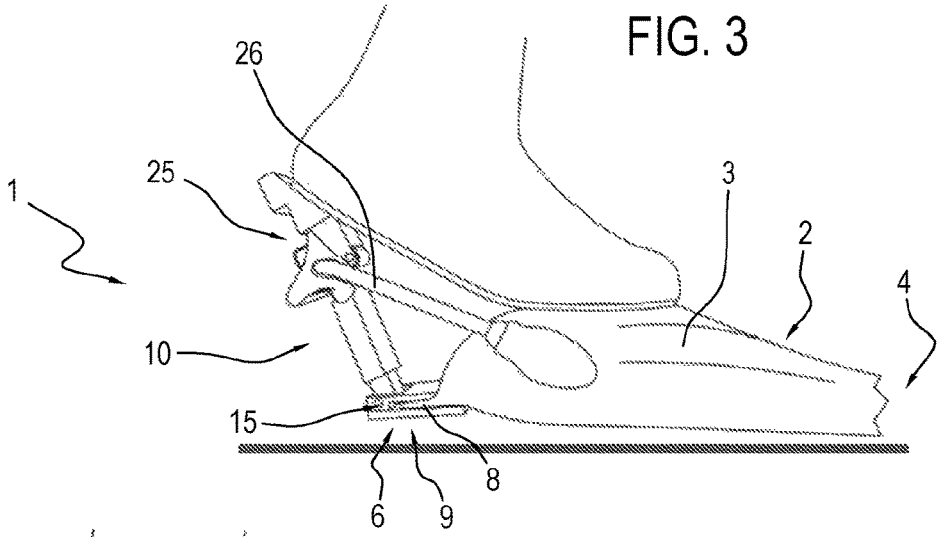
FIGS. 3 to 5 are a succession of steps in the use of the apparatus for putting on flippers according to the invention, in a partial schematic side view and with some parts removed for greater clarity.
Figure 4:
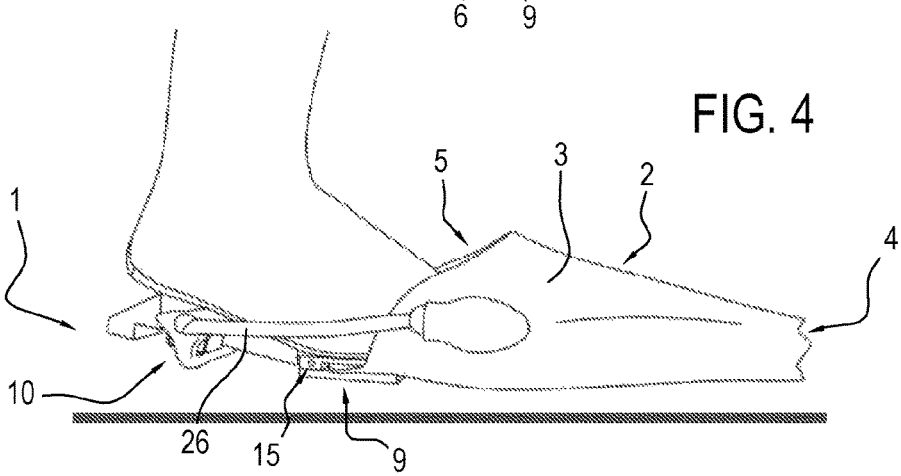
Figure 5:
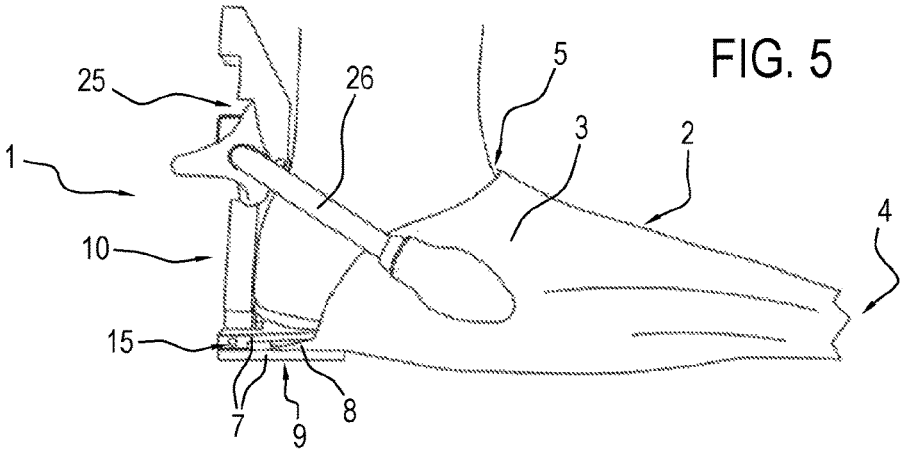

The retaining means 10, on the side opposite the roller 23 and facing the roller 23, comprise a seating 25 for containing an elastic strap 26 which forms part of the flipper 2 (see FIGS. 3 and 5).

The strap 26 can be housed in the seating 25 only by overcoming the action of the elastic force thereof. The strap 26 can also be housed in the seating 25 and rigidly engaged thereto by means of a screw clamp of known type and not illustrated.

The retaining means 10 comprise a second upper end 27, opposite the first end 17, which extends slopingly so as to facilitate rotation about the hinge 15, by means of a sloping surface 28.

In use, after manually securing the attaching means 9 to the sole 8 of the shoe 3, it is sufficient to press the foot downwards acting on the sloping surface 28 so that it performs a rotation with respect to the retaining means 10 about the hinge 15.

This rotation enables opening the housing 5 and inserting the foot inside it, as shown in the sequence of figures from 3 to 5.

The foot can therefore slide first on the roller 23 and, having passed beyond the step 22, slide on the rollers 20 reaching the definitive position simply and correctly, without the user having to use either his own hands or enlist the help of other persons.

As the hinge 15 is located at a height equal to the level of the sole 8 of the shoe 3 and the seating 25 which contains the elastic strap 26 in a position proximal to the end 27, it will be impossible for a zero momentum to be reached and the elastic strap 26 is capable of applying a momentum which guarantees that the retaining means 10 secure and retain the foot inside the shoe and therefore retain the flipper in the correct position during the entire time of use thereof.

As regards the removal of the user's foot, both in water and in a dry zone, it will be sufficient to extract the attaching means 9 from the sole 8 and the apparatus 1 will be easily removable, by automatically freeing the foot from the shoe 3.

In order to make the apparatus 1 still more versatile, systems for adjusting the height of the step 22 or other dimensions can be introduced so as to adjust them as a function of the measurement of the footwear and therefore of the shoe 3 of the flipper 2.

In a second embodiment too, illustrated in figures from 6 to 11, the apparatus 1 comprises retaining means 10 of the underwater swimmer's foot in the correct position inside the housing 5 of the flipper 2, and comprises removable attaching means 9 to the flipper 2. The retaining means 10 and the attaching means 9 are mechanically connected to one another.

The attaching means 9 of the flipper 2 comprise a pair of jaws 6, which in the second embodiment are each realised with a substantially ring-shaped plate 31.

The two plates 31 face each other and are spaced by a dimension such as to reciprocally enable the entry thereof of a base or sole 8 of the shoe 3 of the flipper 2. The distance between the two plates 31 is therefore constituted by the thickness of the material which forms the sole 8.

The attaching means 9 are therefore removably associable to a portion of the base 8 of the shoe 3.

In this way, in use, the sole 8 of the shoe 3 is interposed between a lower plate 31*a*, positioned beneath the sole 8 of the flipper 2, and an upper plate 31*b*, positioned above the sole 8 and partly inside the housing 5.

Figure 6:
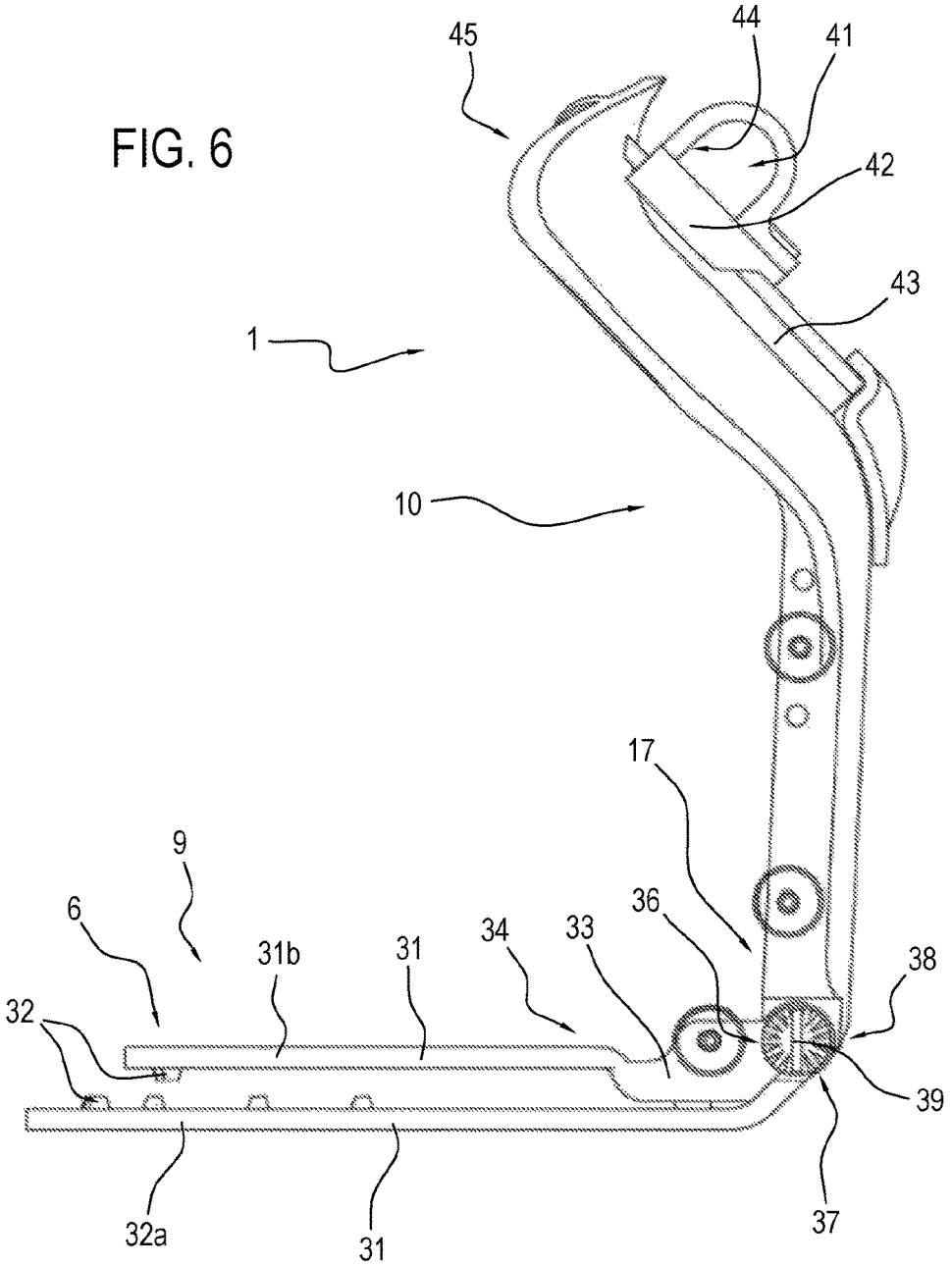
FIG. 6 illustrates an apparatus for putting on flippers in a second embodiment according to the invention, in a partial schematic side view, and with some parts removed for greater clarity.
Figure 7:
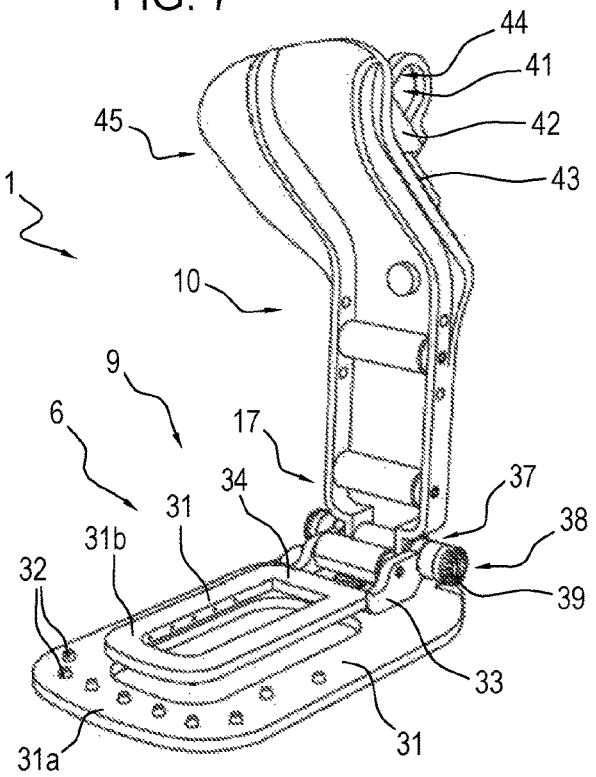
FIGS. 7 and 8 illustrate an apparatus for putting on flippers in the second embodiment of the invention in a partial perspective schematic view and with some parts removed for greater clarity.
Figure 8:
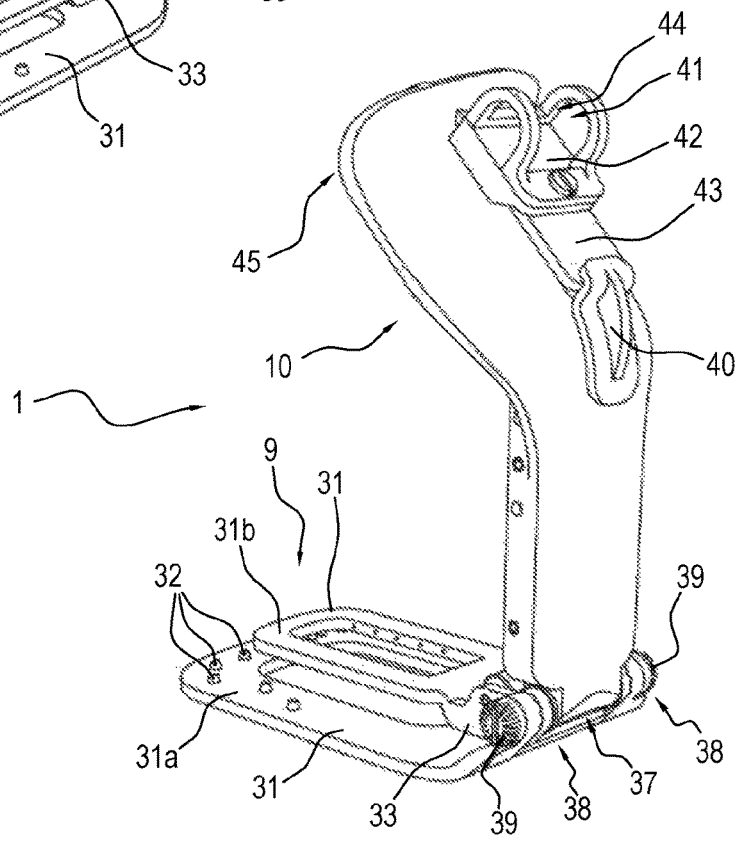
Figure 9:
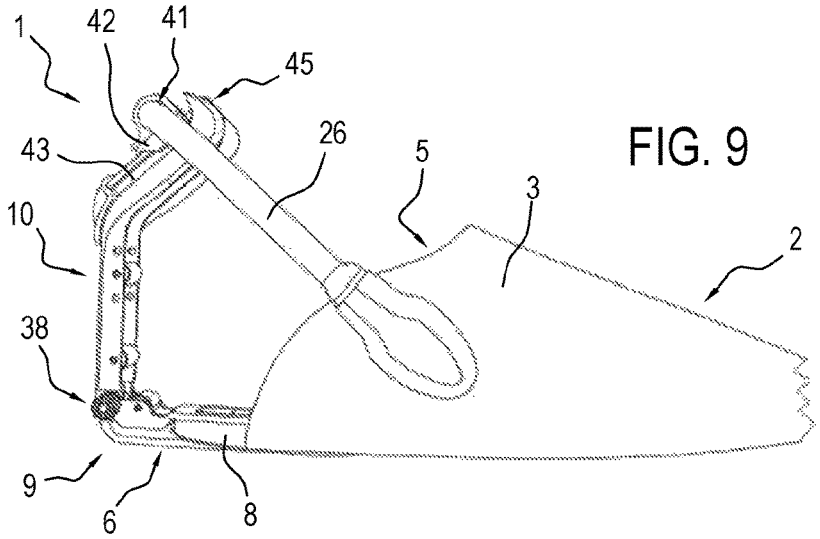
FIGS. 9 to 11 show a succession of steps of use of the apparatus for putting on flippers according to the invention, in a partial schematic side view and with some parts removed for greater clarity.
Figure 10:
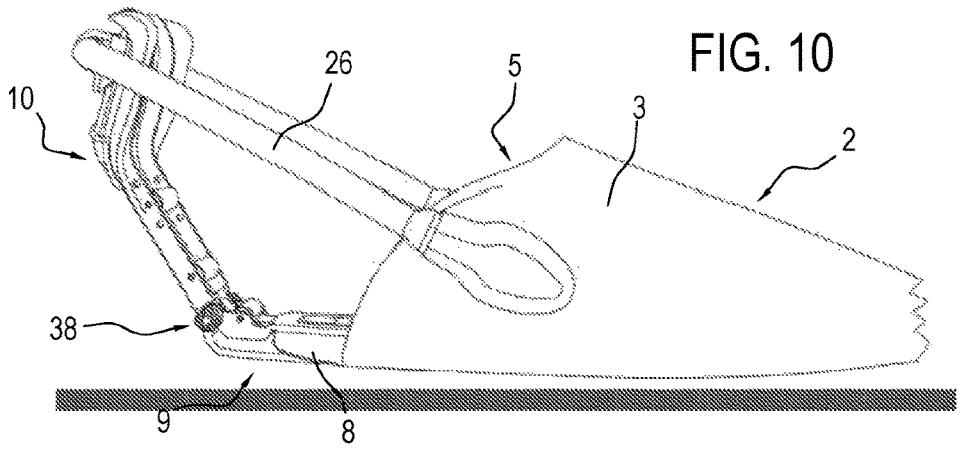
Figure 11:
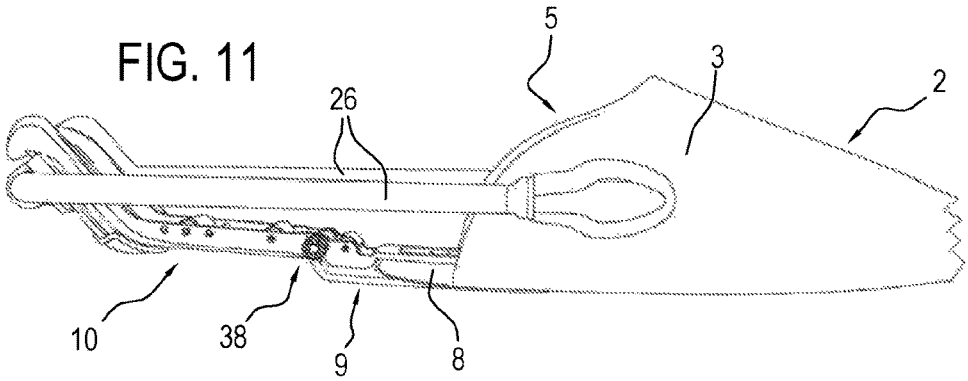

As illustrated in FIG. 6, both the lower plate 31*a* and the upper plate 31*b* comprise substantially wedge-shaped projections 32 in order to enable a better anchoring to the sole 8 of the flipper 2 and therefore to enable secure connection of the apparatus 1 to the flipper 2 during use thereof.

The distance between the two plates 31 is defined by the thickness of a raised part 33 present in the upper plate 31*b* at an end 34 thereof, which, in use, is positioned externally of the shoe 3. This thickness of the raised part 33 can depend on the thickness of the sole 8.

As shown in FIG. 6, inside the raised part 33 there is a through-hole 36 having an axis parallel to the lie plane defined by the plates 31. A spindle is internally present in the hole 36, of a similar type to the spindle of the first embodiment and denoted in FIG. 2 by reference numeral 14. The spindle in the hole 36 constitutes a hinge 37 in which the retaining means 10 are pivoted.

In the second embodiment, the fulcrum, constituted by the hinge 37, has at least a blocking element 38. The blocking element 38 can be located at least on one side or, preferably, on both sides of the hinge 37.

The blocking element 38 can be made in various ways, for example by an enmeshing of two opposite front couplings, which by means of a screw 39 are angularly connected to one another and do not enable reciprocal distancing of the two plates 31*a* and 31*b* , when, in use, the blocking element 38 is clamped by the screw 39.

In this second embodiment there is a further alternative, independent of the blocking of the plates 31, which relates, in the first embodiment, to the seating 25 for containing an elastic strap 26 which forms part of the flipper 2 (see FIGS. 3 and 5).

In this still further embodiment, illustrated in FIGS. 6 to 11, the strap 26 can be housed in a seating 41 which comprises a slide 42 able to slide in a guide 43. The strap 26 can also be housed in the seating 41 and be rigidly engaged on the slide 42 through at least an opening, for example a hole 44 of known type, internally of which the strap 26 is inserted.

The slide 42 can slide from a high position, when the retaining means 10 are in retaining position, to a lower position, when the retaining means 10 are in laid-out position, for allowing the insertion of the flipper 2. The slide 42 is illustrated in raised position in FIGS. 6 to 11, while it is not illustrated in the lower position, which in any case corresponds to the position the slide can reach by sliding in the guide 43.

This lower position is opposite the raised position with respect to the guide 43. The slide 42 can also be extracted from the guide 43 by removing a stop 40 arranged inferiorly of the guide 43 itself. This stop 40 is movable between a blocking position (illustrated in FIG. 8) and an open position (not illustrated). In particular the stop 40 is movable by a angular rotational movement.

In the second embodiment there is a further alternative, independent of the alternative of blocking the plates 31 and the slide 42, that relates to the retaining means 10. In particular it relates to a variant of the second upper end 27, denoted by reference numeral 45 (in FIGS. 6 to 11). The second upper end 45 is opposite the first end 17, which in this embodiment extends inclined on the opposite side with respect to the inclination of the first embodiment, so as to facilitate, in use, the rotation about the hinge 15 or 37. The second end 45 has a substantially U-shaped cross-section so as to have a anatomical shape for adapting better to a shape of the user's foot.

Also, in the second embodiment illustrated in figures from 9 to 11, as illustrated in figures from 3 to 5, it will be impossible to reach a momentum (torque leverage) of zero, as the hinge 37 is located at a substantially level height with the sole 8 of the shoe 3 and the seating 41, which contains the elastic strap 26, which is in a raised position in proximity of the end 45. Thus the elastic strap 26 is still capable of applying a momentum which ensures that the retaining means 10 securely retain the foot inside the shoe and therefore retain the flipper in the correct position during the entire time of use thereof.

Also in this embodiment, to remove the user's foot, both in water and in an excessively dry zone, it will be sufficient to extract the attaching means 9 from the sole 8, easily unblocking the blocking element 38, and the apparatus 1 will be easily removable, automatically freeing the foot from the shoe 3.

So as to make the apparatus 1 still more versatile, systems for adjusting the height of the raised part 33 or other dimensions can be included, so as to adjust the regulations as a function of the size of the footwear and therefore of the shoe 3 of the flipper 2.

Further and different mutual blocking elements of the plates 31 can also be introduced, of known type and not illustrated.

Figure 12:
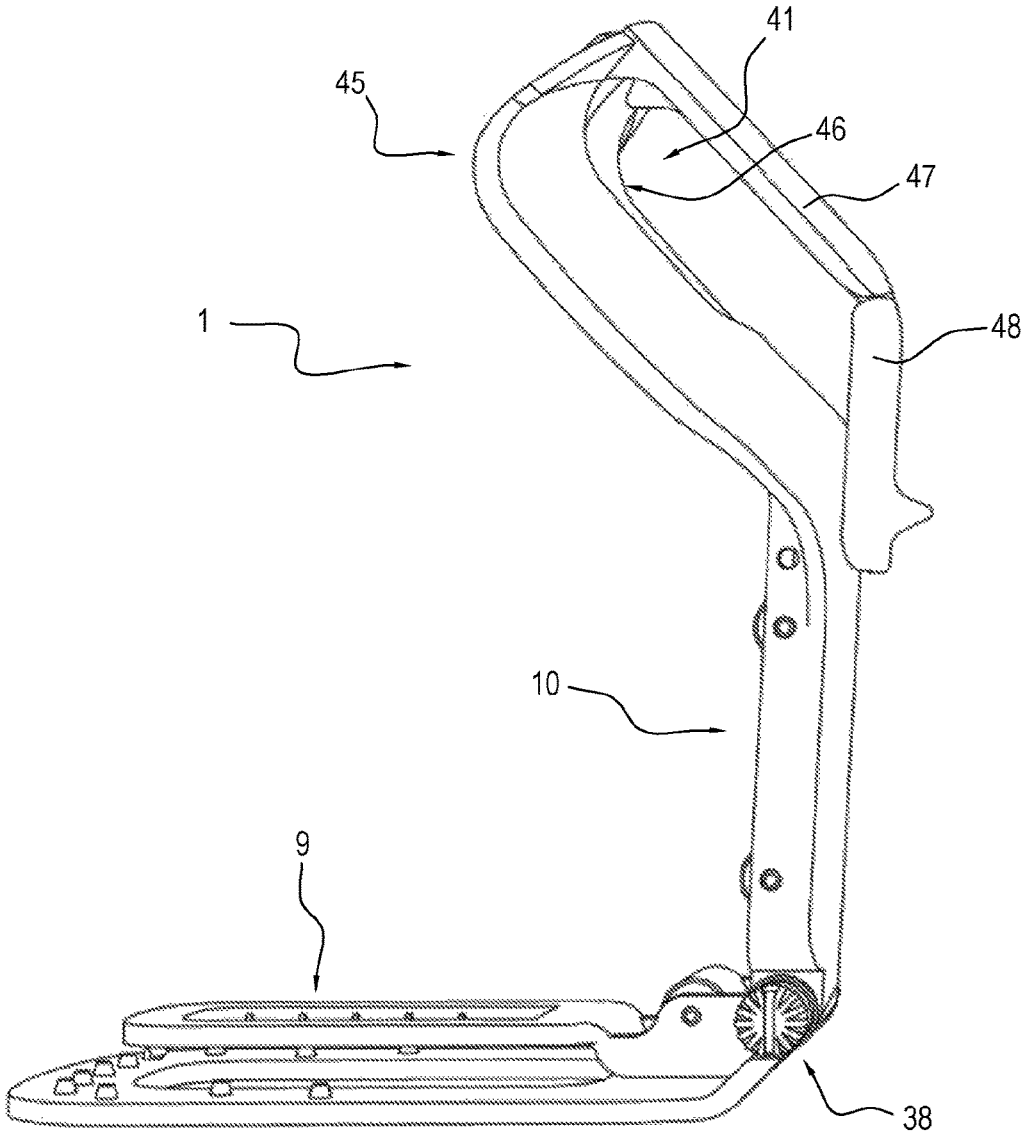
FIG. 12 is a further embodiment of the invention partly alternative to the embodiment of FIG. 6, in a partial schematic side view, with some parts removed for greater clarity.

As illustrated in FIG. 12, a further embodiment according to this invention is also possible, partly as an alternative to the embodiment of FIG. 6, in which the seating 41 of the strap 26 comprises a slot 46. The slot 46 is partly delimited by an abutment 47 joined to the second end 45 of the retaining means 10. The slot 46 is further delimited by a closing element 48. The closing element 48 can preferably be made of an elastically deformable material to allow opening of the slot 46 in order to introduce the strap 26, and for allowing the elastic closing of the same slot 46. Alternatively the closing element 48 may be made of a rigid material, but movable between a closed position of the slot 46 and an open position for allowing the insertion of the strap 26. In this way, during use, the strap is free to move internally of the slot in steps of introducing the foot into the shoe 3, in a way similar to the one described with reference to figures from 3 to 5 and 9 to 11.

An advantage of the embodiments that comprise a seating 41 is that the strap 26 is movable either along the guide 43 or in the slot 46. The possibility of this movement of the strap 26 causes the need for a smaller effort as the strap 26, which elastic, is subjected to traction by the user's foot during the step of introducing the foot inside the opening 5 of the shoe 3 of the flipper 2. This operation is therefore made easier and more comfortable.

Further modifications and improvements can be incorporated without forsaking the scope of the invention as described herein.

The invention claimed is:

1. An apparatus for putting on a flipper comprising: retaining means for retaining a user's foot inside a shoe of the flipper, removable attaching means for attaching to the shoe, wherein the retaining means are mechanically connected and pivoted to the removable attaching means, the removable attaching means being removably associable to a portion of a base of the shoe.

2. The apparatus according to claim 1, wherein the removable attaching means comprise a pair of jaws, each made with a plate.

3. The apparatus according to claim 2, wherein the plate includes a receiving recess and the retaining means is at least partly located in the receiving recess, and further comprising a hinge located in proximity of a first end of the retaining means, the hinge mechanically connecting and pivoting the retaining means to the removable attaching means so that the retaining means is free to rotate relative to the removable attaching means.

4. The apparatus according to claim 1, wherein the retaining means comprises a zone opposing a heel of the user's foot, the zone comprising a slot having an anatomical shape for the heel and constituting a support seating of the heel.

5. The apparatus according to claim 4, and further comprising a roller located on a bottom of the slot and a spindle connected to the retaining means for rotatably mounting the roller.

6. The apparatus according to claim 5, and further comprising a step positioned in proximity to the slot on a side opposite to a hinge, the step constituting a stop and abutment element for the heel of the user's foot.

7. The apparatus according to claim 3, wherein the retaining means comprises a seating for containing an elastic strap of the flipper.

8. The apparatus according to claim 7, wherein the retaining means comprises an upper second end, opposite the first end which slopingly extends so as to facilitate rotation about the hinge, through a pushing action applied by the user's foot on a sloping surface.

9. The apparatus according of claim 8, wherein the hinge is located at a same height as a position of the base of the shoe and the seating is in a position proximal to the second end.

10. The apparatus according to claim 7, wherein the retaining means includes a guide and the seating comprises a slide configured to slide in the guide.

11. The apparatus according to claim 3, wherein a fulcrum constituted by the hinge includes a blocking element.

12. The apparatus according to claim 1, wherein the plate is at least one chosen from U-shaped and ring shaped.

13. The apparatus according to claim 7, wherein the seating comprises a slot.

* * * * *